US005503386A

United States Patent [19]

Straessler et al.

[11] Patent Number: 5,503,386

[45] Date of Patent: Apr. 2, 1996

[54] DEVICE FOR TRANSFERRING A SCALE-SHAPED FLOW CONSISTING OF PRINTED PRODUCTS

[75] Inventors: René Straessler, Jestetten, Germany; Beat Fritsche, Greifensee, Switzerland

[73] Assignee: Grapha-Holding AG, Hergiswil, Switzerland

[21] Appl. No.: 284,424

[22] PCT Filed: Nov. 16, 1993

[86] PCT No.: PCT/CH93/00259

§ 371 Date: Aug. 3, 1994

§ 102(e) Date: Aug. 3, 1994

[87] PCT Pub. No.: WO94/13566

PCT Pub. Date: Jun. 23, 1994

[30] Foreign Application Priority Data

Dec. 4, 1992 [CH] Switzerland ..... 03732/92

[51] Int. Cl.[6] ..... B65H 5/00

[52] U.S. Cl. ..... 271/225; 271/184; 271/185

[58] Field of Search ..... 271/184, 185, 271/198, 225; 198/457

[56] References Cited

U.S. PATENT DOCUMENTS

| | | | |
|---|---|---|---|
| 2,177,460 | 10/1939 | Renz . | |
| 3,605,980 | 9/1971 | Donahue et al. | 271/225 X |
| 4,201,377 | 5/1980 | Honegger | 271/225 |
| 4,465,270 | 8/1984 | Amato | 271/198 |
| 4,861,014 | 8/1989 | Martin | 271/198 |
| 5,054,760 | 10/1991 | Reist | 271/198 X |
| 5,112,041 | 5/1992 | Honegger | 271/184 X |

FOREIGN PATENT DOCUMENTS

| | | |
|---|---|---|
| 1260290 | 2/1968 | Germany . |
| 3608055 | 11/1986 | Germany . |

*Primary Examiner*—David H. Bollinger
*Attorney, Agent, or Firm*—Spencer & Frank

[57] ABSTRACT

A downward-leading step is disposed between a first and second conveying track, where a first scale-shaped flow is spread open and transferred into a second, deflected scale-shaped flow. Pressure rollers are disposed ahead of and behind the step, which rest against the top of the first or second scale-shaped flow and constitute means for aligning the second scale-shaped flow. In this way the exact evenness and directional consistency of the deflected scale-shaped flow is ensured without a lateral guidance panel.

7 Claims, 1 Drawing Sheet

DEVICE FOR TRANSFERRING A SCALE-SHAPED FLOW CONSISTING OF PRINTED PRODUCTS

BACKGROUND OF THE INVENTION

The invention relates to a device for transferring a first scale-shaped flow consisting of printed products and conveyed on a first conveying track to a second scale-shaped flow conveyed on a second conveying track and extending obliquely in respect to the first scale-shaped flow, with means for aligning the second scale-shaped flow straight in the direction of its conveyance.

Devices of this type are generally known. They have a lateral panel for aligning the printed products of the second scale-shaped flow, which extends parallel with the second conveying track and along which the printed products glide, their edges resting against it. Sometimes brushes or rollers are used in place of the lateral panel. If the printed products consist of printed products which are folded inside each other and are laterally offset in respect to each other, the edges of the printed products are damaged by the impact against the lateral panel and the printed products which are folded inside each other are displaced in respect to each other. Because of this the further, subsequent processing can be hampered.

SUMMARY OF THE INVENTION

It is the object of the invention to provide a device of the type mentioned which avoids the said disadvantages and therefore permits a considerably more gentle treatment of printed products conveyed in the scale-shaped flow. In spite of this the device is intended to be functioning dependably and to be advantageous regarding its manufacture and maintenance.

The object is attained in a device in that a downward leading step is disposed between the first and second conveying tracks, and that the means for the straight alignment of the second scale-shaped flow guide the first and second scale-shaped flow from above. In the device in accordance with the invention, the first and second scale-shaped flows are guided from above so that a lateral buffer panel or the like is not required. The lateral edges of the second scale-shaped flow are therefore free and are not stressed. Thus, the edges of the printed products cannot be damaged and the lateral offset of the printed products cannot be changed. A step is disposed between the two conveying tracks, which temporarily spreads open the second scale-shaped flow in this area. It now has been surprisingly found that this spreading considerably eases the guidance of the printed products, and even with large size printed products even makes such guidance possible. Presumably the reason for this is that the printed products are more movable in the area of the step and lateral forces here cannot result in an interference with the scale-shaped flow. It is therefore essential that the direction and exact lateral evenness of the diverted printed products independently of the conveying speed are not changed.

BRIEF DESCRIPTION OF THE DRAWINGS

An exemplary embodiment of the invention will be described in detail below by means of the drawings. Shown are in.

DETAILED DESCRIPTION OF THE INVENTION

Figure 1:
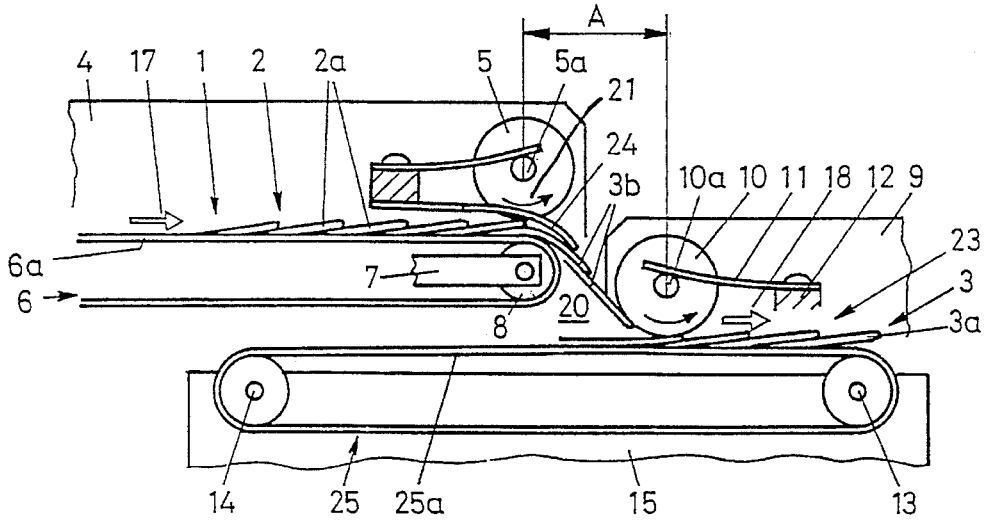
FIG. 1, a partial view of a device in accordance with the invention.

The device has a first conveying track 1 with at least two conveyor belts 6 extending parallel to each other in the direction of the arrow 17. The belts 6 are driven in a manner known per se by a drive, not shown here, by means of a shaft 16 and at the front end are respectively passed over a roller 8. The endless belts 6 can be telescopically adjusted in such a way that a front edge K of the conveying path can be parallel adjusted. Such telescoping belts are well known per se. A scale-shaped flow (first imbricated flow) 2 of printed products 2*a* can be conveyed in the direction of the arrow 17. The printed products are newspapers or magazines, for example, which consist of parts which are disposed laterally offset. As can be seen, the scale-shaped flow is conveyed essentially diagonally in respect to the printed products 2*a*. Other suitable conveying means instead of the belts 6 are also conceivable for conveying the scale-shaped flow 2.

Three pressure rollers 5 are respectively disposed above a belt 6*a* a short distance behind the edge K and seated on shafts 5*a*. The shafts 5*a* are seated, adjustable in the long direction of the belts 6, in a frame 4. In this way, when the reversing rollers 8 are displaced, the rollers 5 can also be displaced by the same amount, or they can be displaced independently of the rollers 8. The rollers 5 are pressed against the top of the scale-shaped flow 2 or the belts 6*a* by means of a spring, not shown here. Thus the rollers 5 are pressure rollers. The rollers 5 are moved around the shaft 5*a* in the direction of the arrow 21 because of the adhesion between the rollers 5 and the scale-shaped flow or the belts 6. However, an embodiment by means of which the rollers 5 are driven via the shaft 5*a* is also conceivable. In any case, the circumferential speeds of the rollers 5 are the same as the conveying speed of the scale-shaped flow 2. The rollers 5 cause the printed products 2*a* to be guided over a step (of stepped region) 20 and underneath rollers 10 which also turn passively. Step 20, in which the printed products are spread open, is disposed between the rollers 5 and 10. Spread-open printed products are indicated with the reference numeral 3*b* in FIG. 1. A bent pipe 24, attached on a stationary frame 9, is disposed next to each roller 5. The pipes 24 guide the printed products 2*a* downward over the step 20 against the rollers 10.

The rollers 10 are part of a second conveying track 23 which conveys the printed products in the direction of the arrow 18. On the second conveying track 23 a second scale-shaped (imbicated) flow 3 is formed from the printed product 2*a*, which is deflected by 45°, for example, in respect to the first scale-shaped flow 2. The printed products 3*a* of this deflected scale-shaped flow 3 have edges 3*c* which are arranged straight in relation to each other and parallel to the conveying direction 18.

The conveying track 23 has an endless belt 25 of comparable width, which is driven by means of a shaft 13 and passed around a parallel shaft 14. The conveying speed of the conveying track 23 in the conveying direction 18 is equal to the conveying speed of the first conveying track 1. The rollers 10 are seated laterally adjustable on a shaft 12*a* of a frame 12. The rollers 10 are pressed downward against the the top of the scale-shaped flow 3 by means of a plate spring 11, also housed on the frame. The shaft 12*a* is fixed on a rod 12*b* of the frame 12 and adjustable in the directions of the two-headed arrow 22. At the same time the rollers 10 can be displaced in the directions of the two-headed arrow 22. The rollers 10 are also pressure rollers and are preferably turned passively on the shaft 12*a* by means of adhesion in accordance with the conveying speed of the belt 25. The rollers 10 grasp the printed products 3*b* guided by the rollers 5 and press them against the upper surface 25*a* of the belt 25. It is assured by means of the corresponding adhesion between the surface 25*a* and the printed products 3*a* that the latter take on the movement direction of the belt 25 and are correspondingly deflected. In addition, the rollers 10 prevent the printed products 3*a* from being laterally displaced on the upper surface 25*a*. It is assured in this way that the edges 3*c* of the scale-shaped flow 3 are aligned straight in respect to each other, as mentioned above. It is essential here that the edges 3*c* are not laterally stressed, at least during the deflection. This also holds true for the opposite ends 3*d*. In this way the rollers 5 and 10 constitute means for guiding the printed products. The rollers 5 and 10 can be replaced by other suitable pressure means, for example belts.

The distance A between the rollers 5 and 10 is adapted to the length of the printed products 2*a*. The distance A can be equal to the length of a printed product 2*a*. However, this distance can also be shorter, so that a printed product is grasped in the area of the step 20 by the rollers 5 as well as the rollers 10. Thus the distance A can be somewhat greater or shorter than the length of the printed products. This distance can be set exactly and fixed by displacing the shaft 12*a* on the rod 12*b*.

Figure 2:
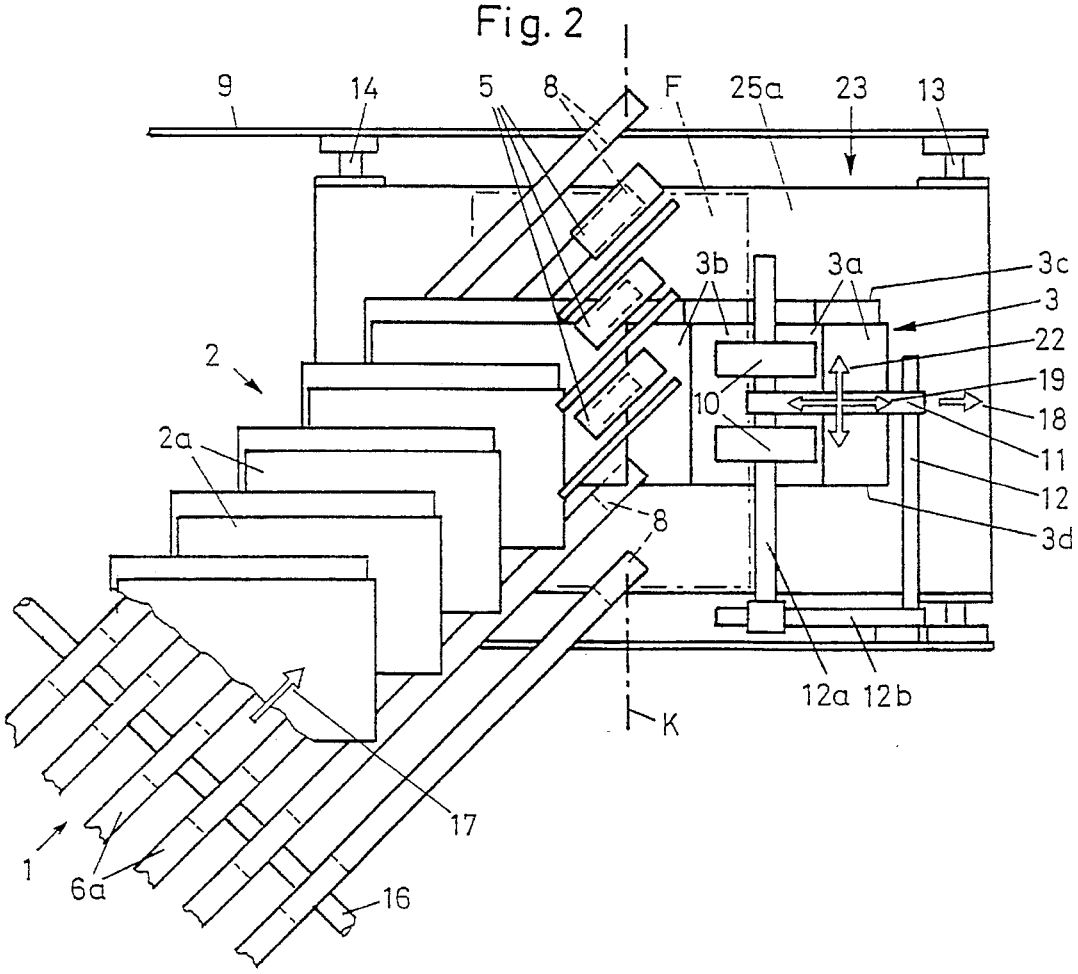
FIG. 2, a further partial view of the device in accordance with the invention.

Printed products of various formats can be deflected by means of the device in accordance with the invention. For example, printed products having the format F, indicated by dash-dotted lines in FIG. 2, can also be deflected. With all formats it is possible to displace the scale-shaped flow 3 laterally in one or the other direction by displacing the edge K. The rollers 10 are then correspondingly displaced by a corresponding displacement on the shaft 12*a*. Once in the position they have been placed, the rollers 10 can of course be fixed against axial displacement by means not shown here. The frames 4, 9 and 12 required for seating and maintaining the conveying tracks 1 and 23 have only been sketched in here, since the construction of such frames is obvious to one skilled in the art. Suitable driving mechanisms for the belts 6 and 12 are also well known to one skilled in the art and need not be explained here.

We claim:

1. A device for transferring a first imbricated flow of printed products into a second imbricated flow of printed products, comprising:

a first conveying track conveying the first imbricated flow of printed products;

a second conveying track conveying the second imbricated flow of printed products, being arranged on a level lower than the first conveying track, and extending obliquely relative to the first imbricated flow;

a stepped region separating the first conveying track from the second conveying track, and joining a downstream end of the first imbricated flow with an upstream end of the second imbricated flow, the stepped region defining a drop edge; and means arranged in the stepped region and comprising a first alignment device located in front of the stepped region, and a second alignment device located behind the stepped region and arranged behind the first alignment device relative to a direction of flow, said first alignment device being located directly adjacent to the drop edge for guiding the printed products to-the second alignment device, said means for aligning the second imbricated flow straight in its direction of conveyance, said means operatively acting upon the downstream end of the first imbricated flow and upon the upstream end of the second imbricated flow.

2. A device as defined in claim 1, wherein said aligning means comprises at least one pressure roller.

3. A device as defined in claim 2, wherein the at least one pressure roller adheres to the printed product to be passively rotated.

4. A device as defined in claim 1, wherein the second alignment device comprises at least one pressure roller, the first alignment device guiding the printed products downward towards the at least one pressure roller.

5. A device as defined in claim 1, wherein the second alignment device is adjustable in at least one of a direction towards the first alignment device and parallel to the stepped region.

6. A device as defined in claim 1, wherein the first conveying track comprises a plurality of belts extending parallel to each other, at least two of the plurality of belts cooperating with the aligning means.

7. A device for transferring a first imbricated flow of printed products into a second imbricated flow of printed products, comprising:

a first conveying track conveying the first imbricated flow of printed products;

a second conveying track conveying the second imbricated flow of printed products, being arranged on a level lower than the first conveying track, and extending obliquely relative to the first imbricated flow;

a stepped region separating the first conveying track from the second conveying track, and joining a downstream end of the first imbricated flow with an upstream end of the second imbricated flow;

means arranged in the stepped region and comprising a first alignment device comprising a plurality of pressure rollers located in front of the stepped region, and a second alignment device located behind the stepped region and arranged behind the first alignment device relative to a direction of flow, said means for aligning the second imbricated flow straight in its direction of conveyance, said means operatively acting upon the downstream end of the first imbricated flow and upon the upstream end of the second imbricated flow; and a guide device arranged next to said pressure rollers and extending over the stepped region.

* * * * *